United States Patent [19]

Knutsson et al.

[11] 4,047,907

[45] Sept. 13, 1977

[54] DUST SEPARATOR APPARATUS

[75] Inventors: Filip Knutsson; Lars Bergström, both of Vaxjo, Sweden

[73] Assignee: AB Svenska Flaktfabriken, Nacka, Sweden

[21] Appl. No.: 635,272

[22] Filed: Nov. 26, 1975

[30] Foreign Application Priority Data

Dec. 4, 1974 Germany ..... 2457255

[51] Int. Cl.[2] ..... B03C 3/41

[52] U.S. Cl. ..... 55/147; 55/148; 55/152

[58] Field of Search ..... 55/140, 141, 147, 148, 55/149, 150, 152, 153; 339/273 R, 273 F, 276 R, 277 R; 24/115 M, 136 R; 403/197, 201, 215, 252, 263, 264, 373, 374, 376, 409

[56] References Cited

U.S. PATENT DOCUMENTS

| | | | |
|---|---|---|---|
| 1,601,771 | 10/1926 | Rowland | 55/147 |
| 1,634,372 | 7/1927 | Lewers | 55/148 |
| 1,846,169 | 2/1932 | Weiskopf | 55/141 |
| 2,107,835 | 2/1938 | Pierce | 339/273 R |
| 3,774,372 | 11/1973 | Heer et al. | 55/153 |
| D. 236,002 | 7/1975 | Porle et al. | D26/1 L |

FOREIGN PATENT DOCUMENTS

| | | | |
|---|---|---|---|
| 2,018,447 | 11/1971 | Germany | 55/152 |
| 45-15959 | 6/1970 | Japan | 55/150 |
| 727,988 | 4/1955 | United Kingdom | 24/115 M |
| 1,016,905 | 1/1966 | United Kingdom | 55/152 |
| 338,739 | 11/1930 | United Kingdom | 55/147 |
| 999,051 | 7/1965 | United Kingdom | 55/152 |

*Primary Examiner*—Frank W. Lutter
*Assistant Examiner*—David L. Lacey
*Attorney, Agent, or Firm*—Howson and Howson

[57] ABSTRACT

A dust separator in which a plurality of elongated emission electrodes are detachably held at one end in respective holder fittings secured to a pair of parallel, slightly-resilient inner frame members, or holders, which in turn are secured to substantially non-resilient outer frame members, and at their other ends in at least one holder fitting secured to a common cylindrical central holder extending between and parallel to the frame members; the electrode assembly is tensioned by adjustment of screws fastening said inner frame members or holders to said outer frame members. In one form the holder fittings are hollow cylinders through which the electrodes extend, and the electrodes are positioned in the fittings by their bent-over ends and clamped therein by tubular members forced into the hollow cylinders. In another form, specially-shaped holder shoes are used, in which dove-tailed ends of the electrodes are held. In both forms, the emission electrode preferably is folded slightly about its longitudinal axis to produce a V-shaped cross section which provides strength, good electrical contact and ease of assembly.

14 Claims, 9 Drawing Figures

DUST SEPARATOR APPARATUS

The present invention relates to electrical dust separators and especially to high-voltage electrostatic precipitators.

Electrostatic dust precipitators are known which employ high-voltage electrical emission electrodes for cleaning dust-containing gases, especially waste gases. In one form of such precipitators, emission electrodes electrically connected with the negative pole of a high-voltage rectifier are disposed centrally between precipitation electrodes which are connected to a common ground. The emission electrodes emit in their direct vicinity ions which provide the dust particles, in the waste gases passing by, with a negative charge. The particles charged in this way are influenced by the electric field in such a direction that they migrate to the more-positive precipitating electrodes. On the precipitation electrodes there is thereby formed a coherent layer of dust, which can be removed by the aid of a striking mechanism, and then transported away in some suitable way.

The emission electrodes are inserted as individual parts in a framework, and various strict requirements as to such an installation have to be met. In the first place the connection between the framework and electrodes must be very electrically-conductive, not only in theory, but also in the reality of a dust-rich environment containing, for example, corrosive substances. There also must be taken into consideration the high mechanical stresses caused by the operation of a striker mechanism, by which not only may the electrical conductivity of the connection be endangered, but there is also a risk of breaking an emission electrode in the region near the connection, which in many cases would lead to a short-circuit in the equipment. This in turn might mean that operations would have to be stopped entirely or partly during repairs, and this could require a long shut-down time. Also, derangements in the operation of dust-separating equipment almost always mean that large amounts of uncleaned gas can get into the atmosphere, with serious contamination of the surroundings.

An object of the invention is to counteract these drawbacks and to eliminate them as far as possible.

In accordance with the invention, this problem is solved by the construction of a dust separator described and claimed herein.

Details and advantages of the invention are evident from the following description, taken with the accompanying drawings, in which.

Figure 2:
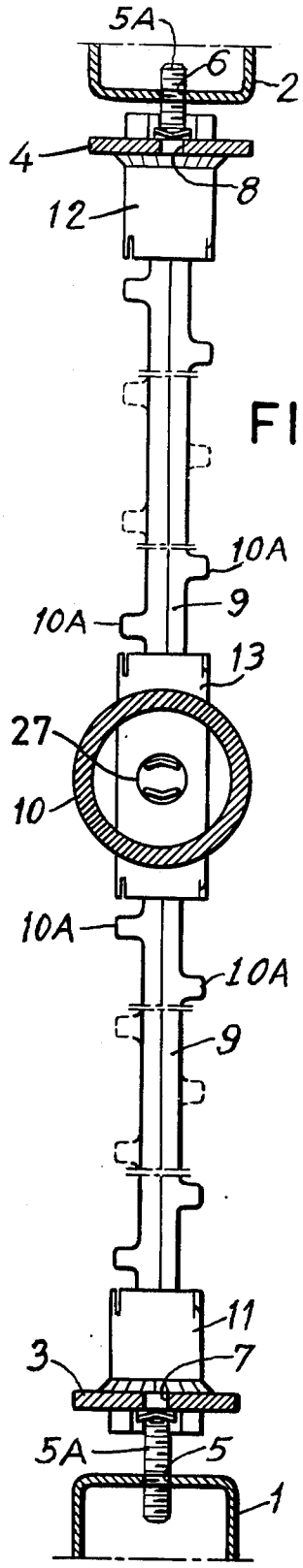
FIG. 2 shows the same assembly as seen from the left of FIG. 1.

Corresponding parts of the figures of the drawings and designated by the same reference numerals. Common to the two examples of the invention are outer frame members 1 and 2, spaced apart from and parallel with one another. The said frame members are preferably substantially non-resilient and are advantageously made as hollow beams of U-shaped profile. These frame members are for example associated with holders 3 and 4 which are made of flat iron strips the major faces of, which run plane-parallel to the adjacent surfaces of the corresponding outer frame members and to each other, holders 3 and 4 are attached to frame members 1 and 2 respectively. As an attaching means there may for example be provided threaded bolts in threaded holes, or screw and nut connections may be used. For example, these attaching means may comprise threaded bolts 5A extending through clearance holes 7 and 8 into threaded holes 5 and 6.

Figure 1:
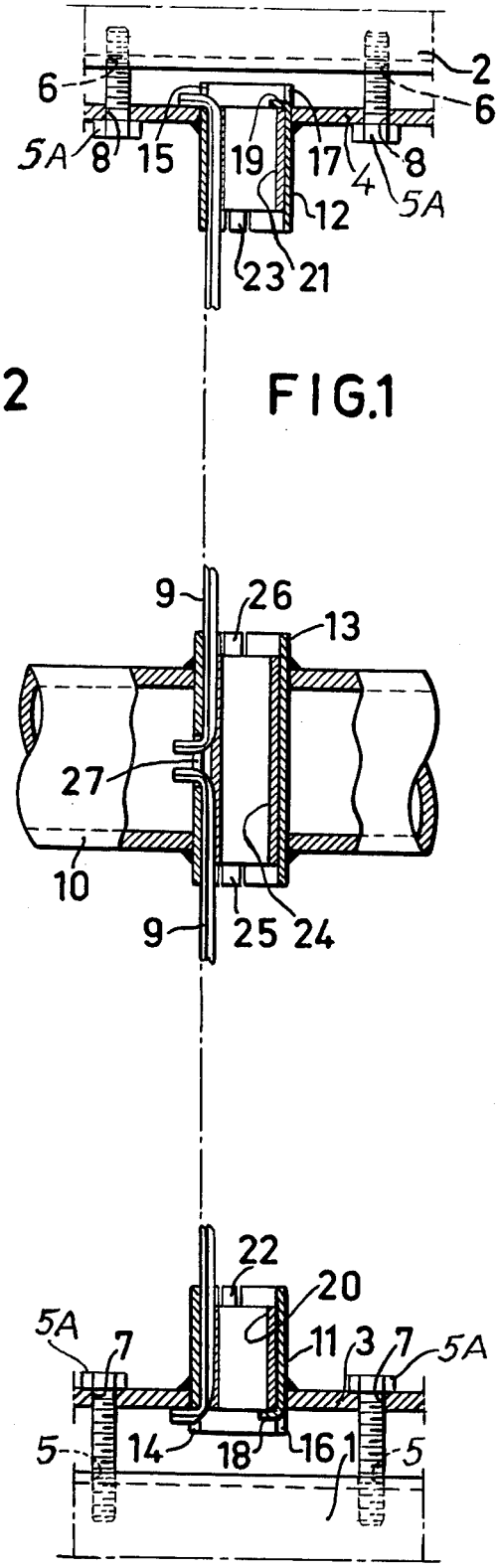
FIG. 1 shows, in a partly sectioned side view, a discharge electrode mounting assembly in accordance with the invention.
Figures 3, 4, 5, 6, 7, 8, 9:
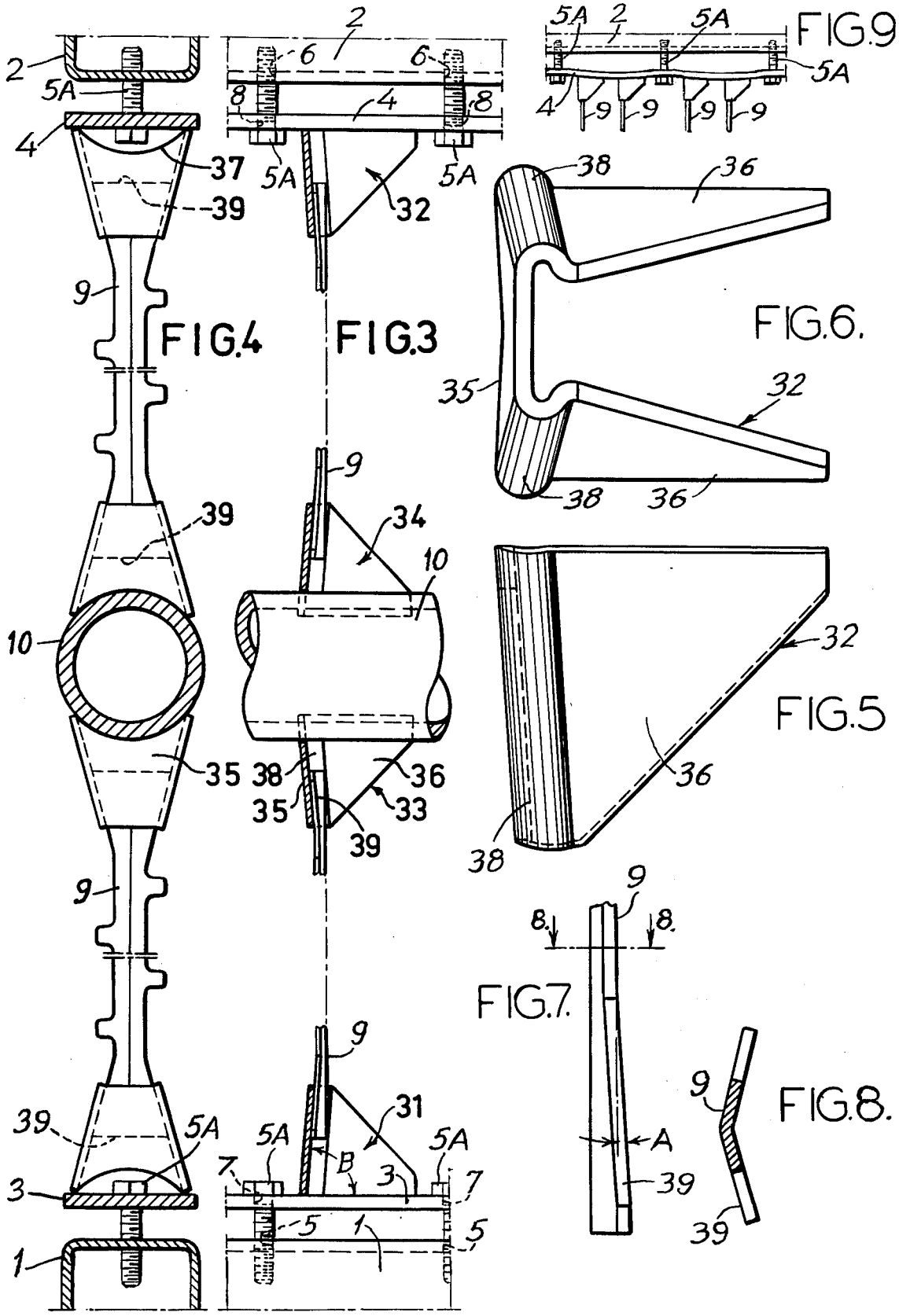
FIG. 3 shows a modified form of construction, in a partial side view, of a discharge electrode mounting assembly according to the invention.
FIG. 4 shows the assembly of FIG. 3 as seen from the left.
FIG. 5 is a sideview of an electrode-holding shoe such as 32 in FIG. 3.
FIG. 6 is an inverted plan view of the shoe of FIG. 5.
FIG. 7 is an enlarged fragmentary view of the dovetail end of one of the electrodes 9.
FIG. 8 is a sectional view along lines 8—8 of FIG. 7.
FIG. 9 is a fragmentary elevational view showing a preferred arrangement of screw fasteners.

Between the holders 3 and 4 extend electrodes 9, in the illustrated case preferably emission electrodes, which in the preferred form of construction shown do not extend in one piece between the holders, but bridge over this distance in pairs; in FIGS. 1 and 2, the ends of the electrodes are turned at right angles and along the same direction, and one end of each electrode in each pair is fastened in a central holder 10, which preferably consists of a tube extending centrally between and parallel to the lengths of the frame-parts and holders. The electrodes 9 are preferably made as so-called rod-electrodes, with projections such as 10A staggered along their two longitudinal edges and with a central longitudinal bend-line, about which the two axial halves of the electrodes are bent slightly toward one another, enclosing for example an angle of 160°, as shown in FIG. 8. It must however be emphasized that other types of electrodes may be used; the design here illustrated and described is merely to be regarded as a nonlimiting example. As to their further details, the two forms of construction shown in the drawings differ from one another, for which reason there will first be described the example of FIG. 1 and FIG. 2.

Here the holders 3 and 4 are equipped with tubular fittings 11 and 12, which go through the holders 3 and 4 and may also extend somewhat to the opposite sides thereof. A further corresponding tubular fitting 13 is disposed aligned with the two others, in or on the central holder 10. Advantageously the tubular fitting 13 goes diametrally through the central holder 10, and extends somewhat to both sides. The fitting 13 is moreover preferably made longer than the two other fittings, because it, contrary to them, has to take two electrode ends. All the fittings may be welded immovably to their holders for example.

One end portion of one electrode 9 extends through and in flat abutment against the inside of the fitting 11, one end portion of the other electrode 9 extends through and in flat abutment against the inside of the fitting 12, and both of said electrodes are bent radially outward at their outer ends, so that the bent ends abut the outer sides of the holders 3 and 4. In this region the tubular fitting 11 is provided with a recess 14 and incisions 16, and fitting 12 is provided with a recess 15 and incisions 17 respectively, each pair of incisions being diametrally arranged in relation to the corresponding recess, and tongues 18, 19 being formed from each pair of incisions. These tongues are bent radially inwardly, thereby to form abutments for the clamp-pieces 20 or 21, which, after the introduction of the electrodes into the tubular fittings 11 and 12, are introduced from the outer side. In the case of cylindrical-tube fittings 11 and 12, the clamp-pieces 21 and 20 are preferably also cylindrical and of diameters suitably smaller than the diameters of the fittings. In this way there is obtained advantageous tight clamping of the electrodes over a long section, through which there is obtained electric conductivity which remains uniform. By the aid of the channel-like cross section of the electrodes, it is easy to introduce the clamp pieces into the tubular fittings. After the introduction of the clamp-pieces they may be secured against loosening, preferably by providing the tubular fittings with tongues 22, 23 formed from pairs of incisions, which are subsequently bent radially inward.

The tubular fitting 13 of the central holder 10 is similarly provided with a clamp-piece 24 and tongues 25, 26. The bent electrode ends go through a common opening 27 and extend radially outward. This opening is preferably surrounded by the central holder 10.

By the aid of the bent cross section form of the electrodes, their ends are to a great extent secured against accidental bending-back. Moreover, in this way there is obtained an elastic clamping or compression between the clamp-piece and tubular fitting concerned. In this way the electric conductivity is increased and guaranteed, along with advantageous retention of the form of electrode.

By the aid of the adjustable setting of the holders 3 and 4 between the outer frame members 1 and 2, it is possible to obtain exactly the clamping force desired for the electrodes. Accidental loosening of the electrodes is practically eliminated, thanks to the careful clamping-in of their ends.

The form of construction shown in FIGS. 3 and 4 is characterized in particular by being cheaper, and it permits particularly rapid application of the electrodes, without loose means and without deformation of them.

Instead of tubular fittings, there are provided, looking in the direction of the electrodes, approximately U-shaped shoes 31, 32, 33 and 34 mounted on the holders 3 and 4, and on the central holder 10, fastened for example by welding. These shoes have a web 35, and from this, at approximately a right-angle, a pair of projecting legs 36 in mirror-symmetry with each other. Each of the latter legs extends in a wedge-like configuration from its anchored side to its free end. A corresponding tapered-down shape is provided for the web 35, as shown in FIG. 4. At its attachment side the web 35 may be provided with a recess 37, which fits the profile of the central holder 10. For reasons of uniformity in making the shoes, such recesses may also be provided in the shoes on the frame-side holders. It is particularly advantageous to stamp the transition region between the legs 36 and the web 35 so that corrugations 38 are produced. These form recesses, which are accessible from the inside of the shoe, and extend through the region between the legs 36 and the web. With a preferred form of construction the inside of the web merges directly into the corrugations 38; the inside of the web, in the region of each corrugation, at first curves somewhat outward, and then merges with the corrugation. The bottoms of said corrugations serve as channels for receiving and retaining the electrode ends as will now be described.

The electrodes 9 are in this case provided with dovetail ends 39, the angles of the flared edges of which correspond with those of the channels in the interior of the shoe. These electrode ends are a bit shorter than the web of the shoe, as shown by the drawing. In this way it is possible for each electrode, with its free-end held near the holder concerned, to be introduced into the shoe approximately plane-parallel to the shoe web. Then the electrode need only be tightened up toward the tapered-down end of the web, so that it becomes automatically caught by its dovetail end in the corrugation 38. Thanks to the similar wedge-angle of the electrode ends and web surface, there is in this way obtained a lineal abutment or contact surface between electrodes and shoes. It is pointed out that it is particularly advantageous in this connection to employ the above-mentioned cross-sectional bend in each electrode. This ensures a particularly reliable seating of the electrodes, and in practice prevents any accidental loosening of them. This design nevertheless permits very rapid installation of the electrodes. Here the holders 3 and 4 are again attached adjustably, in a similar way, to the outer frame members 1 and 2.

The forms of construction described above and shown in the drawings are to be regarded only as non-limiting examples, which may be modified as desired and supplemented within the scope of the inventive idea. It is also possible to combine with one another, as desired, individual parts of the various forms of construction.

Because with the form of construction of FIGS. 3 and 4 the electrode ends 39 are made partly dovetail-shape and are partly bent about a central axial bend-line, the tapered-down edges of the electrode ends 39 make a certain angle A with the electrode axis. This means that each shoe web 35, at its leg side, encloses with the holder 3 or 4 concerned, or with 10, a correspondingly smaller angle B, i.e. in the illustrated case an angle smaller than 90°, as is clearly shown by FIG. 3. In this way there is prevented deformation, i.e. a deviating bending of the electrode ends, and thus a weakening of the electrodes. At the same time there is obtained a still more advantageous attachment of the electrodes, which is to a great extent secured against transverse stressing. Such transverse stressing is caused by the striking mechanism usually acting in the direction of the holder concerned.

In a preferred form of construction of the invention the holders 3 and 4 are made with some limited elasticity. This is preferably achieved through making the cross-sectional dimensions of the holders suitably small in thickness. In this way, in the tightening up of the threaded-nut connections or the like, the holders become elastically deformed, so that there is produced in a side view a nearly flat undulated form. As a result, crests are situated in the region of the said connections, while the electrode-anchoring regions are situated in the valleys. This produces a certain reserve of elasticity, and the electrodes are always anchored under stress. It is particularly advantageous to have one screw-nut connection or the like between every second electrode anchorage along the frame, as shown in FIG. 9. This provides, with few and simple means, an advantageous individual elastic anchoring of each individual electrode.

An electrode having an axial fold similar to that of electrode 9 is shown in U.S. Pat. No. DES 236,002 of Porle et al, filed in the United States on Oct. 17, 1973 based on a corresponding West German application filed Apr. 18, 1973. An electrode shoe similar to that shown in FIGS. 5 and 6 is shown in U.S. design application Ser. No. 581,892 of Filip Knutsson and Lars Bergstrom, filed May 19, 1975.

While the invention has been described with particular reference to specific embodiments in the interest of definiteness, it will be understood that it may be embodied in forms diverse from those shown and described in detail, without departing from the spirit and scope of the invention as defined by the appended claims.

We claim:

1. In a discharge electrode assembly comprising a holder, a discharge electrode, and securing means for securing an end of said electrode to said holder, the improvement wherein said discharge electrode has a dove-tail shaped end which has flared angled edges which are angled about a longitudinal axis therein to form a dihedral angle in cross section, and said securing means comprises a bifuracated shoe, for receiving and holding said dove-tail end of said electrode, said shoe comprising a web and a pair of spaced-apart legs, said legs extending generally in the same direction from opposite ends of said web, one side edge of said web and one side edge of said legs being affixed to said support member, the transitions between each of said legs and said web forming opposed internal channels for receiving and retaining the flared angled edges of said dove-tail end, said channels extending at substantially the same angle as the corresponding ones of said flared edges, whereby said electrode can be installed by slipping said flared angled edges between said legs and into a position between said channels and then urging said electrode longitudinally to establish mating contact between said flared angled edges and said channels.

2. The apparatus of claim 1, in which said legs of said shoe are permanently fastened to said corresponding holder.

3. The apparatus of claim 1, in which the portion of said dove-tail shaped end retained in said shoe is shorter than the length of said shoe web.

4. The apparatus of claim 1, in which each of said legs has an edge extending at a slat from said web end thereof toward the diagonally opposite corner of said leg.

5. The apparatus of claim 1, in which said transition between said shoe web and each of said legs is in the form of a corrugation within which said flared edges of said dovetail end are retained.

6. The apparatus of claim 5, in which the interior surface of said shoe web merges with said corrugations and the inner surfaces of the two shoe legs curve apart from each other at their sides adjacent said corrugations where said electrode end is retained.

7. The apparatus of claim 1, in which said dovetail end is folded about a longitudinal axis therein to provide an angle of less than 180° between the portions thereof on opposite sides of said axis.

8. The apparatus of claim 7, in which said angle is about 160°.

9. The apparatus of claim 1, in which the side of said shoe adjacent said legs forms an included angle of less than 90° with its corresponding holder.

10. The assembly of claim 1, wherein each of said legs is substantially flat and skewed with respect to each other to lie in planes substantially parallel to their corresponding channels, thereby to accommodate said dovetailed end between them during said installing of said electrode.

11. The apparatus of claim 10, in which the base of said shoe, defined by the more widely-spaced edges of said legs and the corresponding side edge of said web, is shaped to fit against one of said holders.

12. In an electrostatic precipitator comprising frames and electric emission electrodes extending between and having ends supported adjacent to said frames:

frame-side holders retaining the ends of said electrodes adjacent said frames, and securing means for securing said frame-side holders to said frames, said securing means being spaced apart along said frames and adjustable to move said holders toward each other or apart in a direction transverse of said frames;

at least one of said holders being sufficiently thin to be elastically deformable adjacent each said securing means in response to tensioning of said electrodes by adjustment of said securing means.

13. The apparatus of claim 12, in which at least one of said holders comprises a flat iron bar.

14. The apparatus of claim 13, in which one of said securing means is located along said bar between every second position at which one of said electrode ends is retained by one of said holders.

* * * * *